US005221082A

United States Patent [19]

Curchod

[11] Patent Number: 5,221,082

[45] Date of Patent: Jun. 22, 1993

[54] ENHANCED GOLF SIMULATION SYSTEM

[75] Inventor: Donald B. Curchod, Woodside, Calif.

[73] Assignee: Ingolf Corporation, Sunnyvale, Calif.

[21] Appl. No.: 830,575

[22] Filed: Feb. 5, 1992

[51] Int. Cl.[5] ..... A63B 69/36

[52] U.S. Cl. ..... 273/185 A; 273/184 R; 273/185 B; 273/185 R; 434/252

[58] Field of Search ..... 434/252; 273/183 C, 273/184 R, 185 A, 185 B, 185 R

[56] References Cited

U.S. PATENT DOCUMENTS

| | | | |
|---|---|---|---|
| 3,643,959 | 2/1972 | Cornell et al. | 273/176 FA |
| 3,690,675 | 9/1972 | Conklin | 273/185 R |
| 3,778,064 | 12/1973 | Nutter | 273/176 FA |
| 4,086,630 | 4/1978 | Speiser et al. | 364/410 |
| 4,136,387 | 1/1979 | Sullivan et al. | 364/410 |
| 4,160,942 | 7/1979 | Lynch et al. | 350/120 |
| 5,056,791 | 10/1991 | Poillon et al. | 273/185 B |

OTHER PUBLICATIONS

The Sornal "Golfomat: 18 holes, nice view, no divots" Feb. 15, 1991.

*Primary Examiner*—Gene Mancene
*Assistant Examiner*—Cindy A. Cherichetti
*Attorney, Agent, or Firm*—Patrick T. King

[57] ABSTRACT

A golf simulator includes a screen for displaying a simulated golf hole. Sensors measure one or more parameters of a hit golf ball hit with a golf club by a player. These parameters may include the velocity, trajectory, and spin of a golf ball. A computer determines the distance and location of the hit golf ball from the simulated hole as a function of the measured parameters. The computer enhances a player's shot by a predetermined enhancement factor. In a preferred embodiment the calculated forward velocity of a hit ball is increased with the enhancement factor to obtain an enhanced forward velocity. The enhancement factor can be a predetermined percentage ranging between 0 and 200 percent. The enhancement factor can be automatically phased out, attenuated, or cancelled as the player approaches the simulated hole. The display screen displays the enhancement factor of a player.

26 Claims, 7 Drawing Sheets

ENHANCED GOLF SIMULATION SYSTEM

BACKGROUND OF THE INVENTION

1. Field of the Invention

This invention relates to golf simulation and, more particularly, to enhancement of a player's performance in a simulated golf game.

2. Prior Art

A standard golf game is played on an outdoor turf course which includes fairways for taking shots with woods and irons and putting greens for putting with putters. Various types of electronic simulators for golf exist.

When a group of players of unequal ability play either a standard golf course or a simulated gold course, problems arise. A better player generally takes fewer strokes, or shots, and hits the golf ball more accurately than does a poorer player. Players may have unequal physical ability or strength so that some players can consistently hit a golf ball farther. As a consequence, the better players often must wait for the poorer players to take additional shots and advance over the golf course. The slower players slow the pace of the game for the better player and this often detracts from the enjoyment of the game by the better players and adds to the embarrassment of the poorer players. This tends to detract from the social aspects of the game, where the players of varying skill levels will enjoy the companionship of playing the game together at a substantially equal skill level. Note that these problems also exist on simulated golf courses.

To equalize the competitive aspects of the game in terms of golf scores, various golf handicap systems are used by which "handicap" strokes are subtracted from a player's score, or final stroke-count to adjust the net score of a player. For example, a skilled golfer is deemed to be able to finish a round of golf on an 18-hole course with the standard number of strokes, or par, for that particular golf course. A lesser skilled player will consistently finish the course with a score above par and is therefore given handicap strokes to be subtracted from his or her total stroke count to obtain a net score for the round of golf. The handicap system is intended to equalize the net scores for the players in a group having different skill levels. However, it does not solve the problems caused by the less skilled, and usually slower, players in a group.

Consequently, the need has arisen for some technique to enhance the performance of the poorer players to a level more competitive with a better player. In a conventional golf game played on a standard golf course, this is difficult to accomplish because of the real physical limitations imposed by the use of standard golf equipment and the real dimensions of standard golf courses.

SUMMARY OF THE INVENTION

Golf simulator systems reduce the amount of real estate needed to enjoy golf by simulating the relatively long fairways used for driving and iron-play. The putting greens and approach areas, including sand traps and the putting surfaces, can be simulated with full-scale physical models. In this type of simulator system, a golfer tees off and progresses down the fairway toward a simulated hole in a simulated green. A video projection of the fairway and hole are provided to simulate the player's view from the simulated place where his or her ball lies on the simulated course. Unequal skill levels between players in a group can detract from enjoyment of the game. It is therefore an object of the invention to provide a technique for selectively enhancing the skill level of a player on a simulated golf course.

In accordance with this and other objects of the invention, an improved golf simulator system and method is provided according to the invention. A display screen is provided for displaying a preselected, simulated golf hole. Sensors measure one or more parameters of a golf ball hit with a standard golf club by a player. In a preferred embodiment, these parameters include the velocity, trajectory, and spin of the ball. A computer determines the distance and location of the hit golf ball from the simulated hole as a function of the measured parameters. The computer is connected to the screen display to control display of images corresponding to the view from a player's lie.

To improve a player's performance relative to another player, the invention provides the computer with shot enhancement means for relatively enhancing a player's shot by a predetermined enhancement factor. The shot enhancement means includes means for increasing the calculated forward velocity of a hit ball to obtain an enhanced forward velocity for that hit ball. In one embodiment of the invention, the calculated forward velocity is enhanced by a predetermined percentage which ranges, for example, between zero percent and 200 percent. The enhancement factor is automatically phased out as the player approaches the simulated hole and can be attenuated according to a predetermined scheme as a function of the player's distance from the hole. In a preferred embodiment of the invention, the enhancement factor can be cancelled at a predetermined distance from the hole. The enhancement factor for a player is displayed on the simulator screen or a computer monitor screen, to avoid cheating.

The invention also provides an improved method of simulating a golf game which includes the step of displaying a simulated golf hole and measuring various parameters with sensors that measure the velocity, trajectory, and spin of a golf ball hit with a golf club by a player. A computer computes the distance and location of the hit golf ball from the simulated hole as a function of the measured parameters, and enhances a player's shot with a predetermined enhancement factor. The predetermined enhancement factor increases, for example, the calculated forward velocity of a hit ball to obtain an enhanced forward velocity for that hit ball. The enhancement factor enhances the forward velocity by a predetermined percentage. The preferred method includes the step of automatically phasing out or attenuating the enhancement factor as the player approaches the simulated hole. This is accomplished, for example, by cancelling or by attenuating the enhancement factor according to a predetermined scheme as a function of the player's distance from the hole. To make the other players in a group aware of a player's enhancement factor, the player's enhancement factor can be displayed on the simulator screen or the computer monitor along with other information.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications, and equivalents which may be included within the spirit and scope of the invention as defined by the appended claims.

Golf simulator systems are used to reduce the amount of real estate needed to enjoy the golfing experience. A standard golf course includes relatively long fairways which are used for driving and iron-play. A standard golf course also includes relatively smaller putting greens and green-approach areas which are used for pitching and putting. The fairway and green areas can be functionally separated in a golf simulator system. In a golf simulator system, each of these areas can be represented differently. For example, the fairways can be electronically simulated from a driving station, while the putting greens and approach areas—including sand traps and the putting surfaces—can be simulated with full-scale physical models. In this type of system, a golfer tees off and progresses down the fairway toward a simulated hole in a simulated green.

As soon as the golfer's ball is within a certain distance from the hole, the golfer moves from the simulated fairway environment within a booth to a separate green area. The green area is be either within the booth or outisde the booth in an adjacent area. The green area may have real or artificial turf. The golfer's ball is placed at a specific location in the putting green or approach area. As determined by the electronics of the simulator system, the ball is placed, for example, at a specific place on the green or in the approach area, such as in a sand trap. The golfer then proceeds to make appropriate chip shots and putts to the hole in the putting green, as required. To provide the golfer with a more realistic simulated environment, video projections of the fairways and greens are provided. These projections may simulate, for example, famous or particularly challenging holes from various golf courses.

Figure 1:
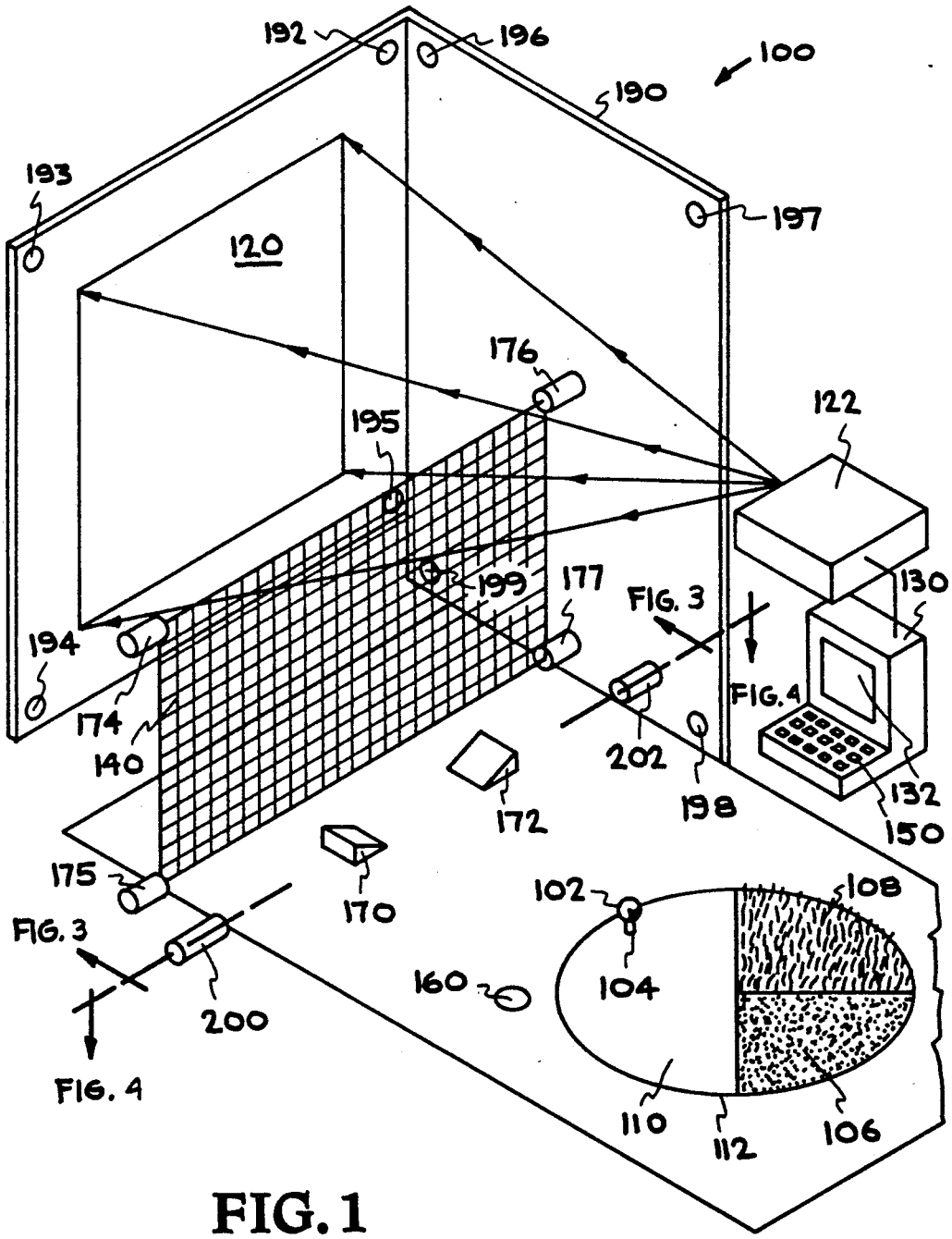
FIG. 1 is a perspective view of a golf simulator system.

FIG. 1 shows a golf simulator system 100 which includes several components. The basic concept is that a golfer sets up a ball 102 on a tee 104 or another alternative, suitable surface, simulating a sand-trap bunker 106, a rough portion 108, and a fairway 110. The tee 104, bunker 106, rough 108, and fairway 110 are located, for example, on a turntable 112, which is easily rotated and locked in place, as required. The golfer then proceeds to drive the ball from the tee 104 using standard golf clubs and an appropriate, normal golf swing to advance the ball toward a simulated hole. To facilitate a realistic golf experience, video images of the fairway and the hole are projected on a screen 120 by a video projector 122. The video images of the various holes of the simulated golf course are produced in a standard personal computer, or work station, 130 and projected on the screen 120, as known in the art.

As the players advances the ball down the course, various lies are expected to be encountered and these are provided on the turntable 112. The computer 130 calculates and provides information indicating which one of these areas has been hit into. This is shown either on the screen 132 of the computer or projected, for example, on the screen 120. The golfer continues to strike the ball from the simulated fairway, or rough, until the ball reaches a predefined distance from the projected, simulated hole.

The golfer drives or strokes the ball from the tee 104 towards a net 140. As the ball travels from the tee 104 to the net 140, the ball passes through a zone in which sensors operate, as described hereinbelow. In this embodiment of the simulator, the projection screen 120 is raised above or is at eye-level with the net 140, permitting the golfer to get a clear view of the screen.

The video projector 122 displays the video image of the hole being played in the same way that a golfer would view the hole as the golfer advances toward the hole. The computer 130 controls a number of functions, as described hereinbelow, and interacts with the golfer through an associated keyboard 150, or user control panel, and various sensors. In a typical scenario for a simulated golfing session, one or more golfers prompt the computer 130 to start a session. The system generates a image of the first hole on the projection screen 140 as viewed from the first tee area. A golfer steps to the tee are drives the golf ball 102 toward the screen 120 as though the golfer were on a real golf course hitting from a tee area toward a real hole. A tee-sensor 160 senses movement of the ball off of the tee 104. This provides for minimum accounting of miss-hit shots which do not register on other sensors.

The ball first will pass through a first plane that is parallel to the plane of the net, or screen, 140. This plane is defined by sensors 170,172 and is approximately perpendicular to the floor of the simulator. The ball then contacts the net 140. The velocity of the ball is calculated from the time that it takes the ball to pass from the first plane (defined by the sensors 170,172) to the time that the ball contacts a second plane (defined roughly by the net 140). In addition, the tee sensor 160 can be used to initiate a velocity measurement. In this case, the calculation of velocity, or speed, is simply a calculation of a distance divided by a time, where the distance is the distance between the first and the second planes and the time is the time for the ball to travel between the two planes. The plane defined by the net 140 is flat and not spherical, so that the distance which the ball travels from the tee to the net varies, depending upon which portion of the net is struck by the ball. Consequently, in order to calculate the trajectory of a golf ball, one of four net sensors 174, 175, 176, 177 are placed at the respective corners of the net 140. The sensors are force sensors and provide appropriate output signals to the computer 130.

Figure 2:
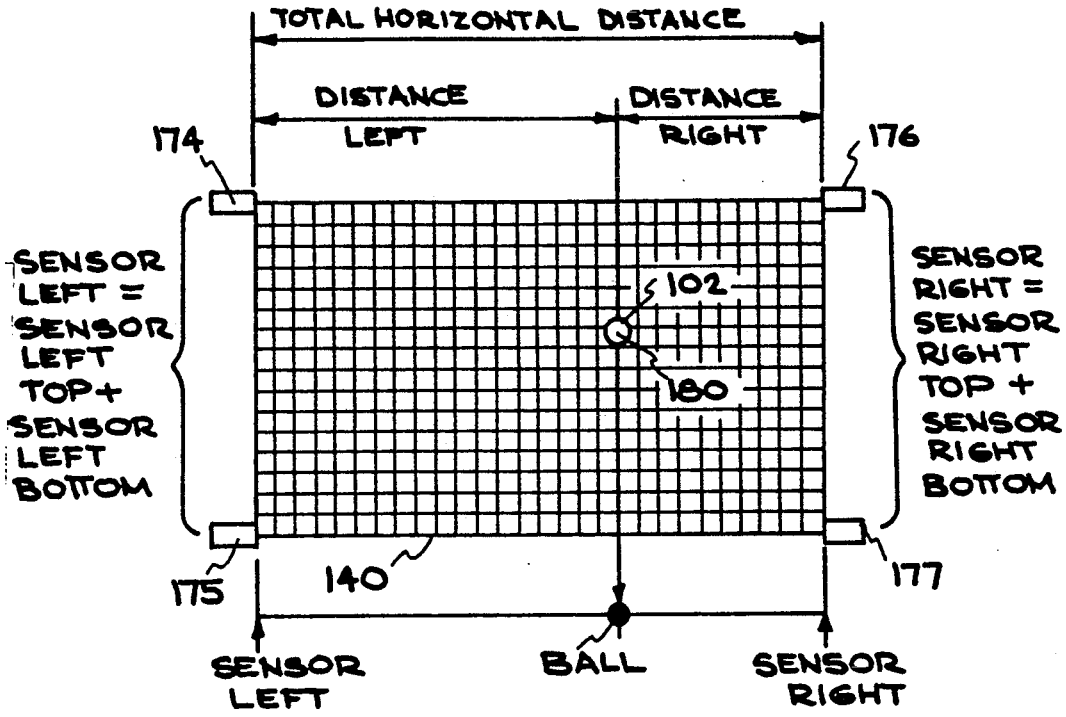
FIG. 2 is a diagram showing net sensors for determining the point at which a driven golf ball strikes a net.

FIG. 2 shows a diagram indicating how the net sensors 174, 175, 176, 177 are used to determine the point at which a driven golf ball strikes the net 140. The location of the sensors and the net relative to the place 180 where the ball strikes the net are shown. Each of the four sensors produces an analog voltage signal which is indicative of the amount of force applied by the ball 102 to the net 140. For example, if the ball 102 contacts the net in its exact center, the signal produced by each sensor will be the same. The peak value of the analog signals from the sensors are converted to digital signals which are sent to the computer 130. A calculation to determine where the ball contacts the net includes several parameters.

For the horizontal component, THD equals the total horizontal distance between sensors. This distance of the ball from the left side is dl and the distance from the right side is dr. The total of the sensor signals from left side is SL, while the total signal of the sensor signals from the right side is SR. When the ball comes to rest, the sensor readings are at their maximum. It can be shown that for the horizontal forces:

$$SLdl = SRdr.$$

Since $THD = dl + dr$ and $dl = (SRdr/SL)$, $$(SRdr) + dr = THD.$$

Solving for dr:

$$dr\ (SR/SL + 1) = THD, \text{ so}$$

$$dr = THD/(sr/SL + 1).$$

This gives the horizontal distance of the ball 102 from the left side of the net 104.

In a similar manner, the vertical position of the ball is determined.

Once the vertical and the horizontal measurements of the ball are known, the distance from the tee 104 to the location 180 of the ball on the net 140 is readily determined using geometry. Other techniques may be used to measure the location of the point where the ball strikes the net. Once the distance from the tee 104 to the point 180 where the ball strikes the net 104 is known, velocity is calculated by dividing the distance by the time of travel between these two points.

The location at which the ball 102 hits the net 104 also is used to determine the trajectory of the ball. The velocity, trajectory, and spin are used to determine where the ball would have landed if the golfer had been playing on a real golf course.

Note that the projection screen 140, wall 190, and a wall (not shown) opposite the wall 190 are used to track miss-hit shots which miss the net 140. Sensors 192, 193, 194, 195 on the wall of the screen 120 and sensors 196, 197, 198, 199 on wall 190 serve the same functions as the force sensors on the net 140. Sensors may also be positioned on a ceiling (not shown) so that all shots are accounted for.

Figure 3:
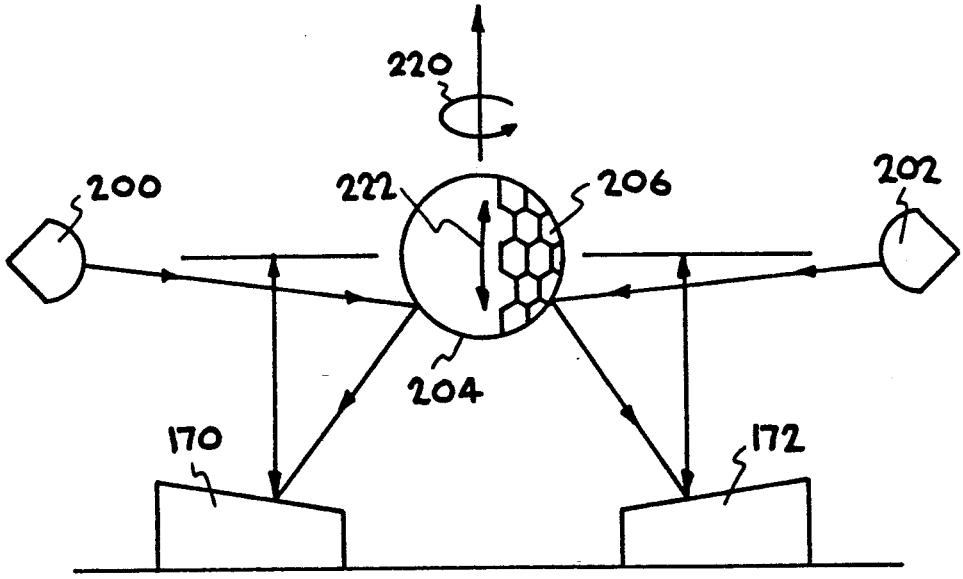
FIG. 3 is a sectional elevation view taken along Section line 3—3 of the golf simulator system shown in FIG. 1, showing a spin sensing arrangement for measuring the spin of a driven golf ball.

FIG. 3 shows a spin sensing arrangement for measuring the spin of a driven golf ball. Spin is an important factor in calculating where a hit golf ball will land because it is used to determine the amount of backspin on the ball and the amount of hook or slice that a shot will take. Measurement of spin is made using light sources 200, 202 in conjunction with sensors 170, 172 as shown in FIGS. 1 and 3.

FIG. 3 shows the relationship between the sensors and the light sources. The light sources 200, 202, respectively, emit a light beam which propagates in a plane defined by the light sources and the sensors. For purposes of the present invention, a special golf ball 204 is used which has highly reflective facets 206, typically shown. The facets serve to reflect light from the light sources onto the respective sensors.

Note that in the context of this description and the appended claims, "golf ball," "golf ball-like object, or the like, are intended to generically represent a ball being played on the simulated golf course by the player. These items are the functional equivalent of a conventional golf ball played on a conventional golf course.

Figure 4:
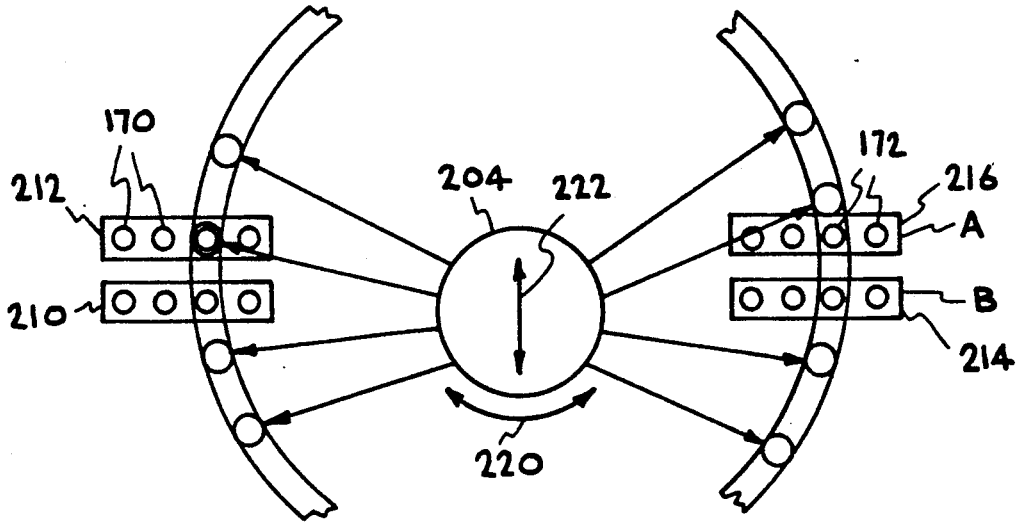
FIG. 4 is a sectional plan view taken along Section line 4—4 of the golf simulator system shown in FIG. 1, showing a spin sensing arrangement for measuring the spin of a driven golf ball.

FIG. 4 shows a plan view of the spin-sensing arrangement for measuring the spin of a driven golf ball. The sensors 170, 172 are divided into two rows 210, 212 and 214, 216. Each of these rows includes a plurality of light-sensing devices. The arrangement of the rows of sensing devices is important for determining the rate of spin in the horizontal and the vertical planes. The horizontal spin component is represented by the arrow 220. As the ball 204 passes into the plane defined by the light sources and the sensors, light from the light sources is reflected from the ball onto the respective sensors.

For the sensor 172, the reflected light strikes row 216 (designated by the reference letter A) and row 214 (designated by the reference letter B) at different times. The direction of horizontal spin is determined by whether light strikes row A before it strikes row B. An additional measurement is made to determine the difference in time between the light striking Row A and the light striking Row B, or vice versa.

In a similar manner, for the sensor 170, the reflected light strikes row 212 (designated by the reference letter A1) and row 210 (designated by the reference letter B1) at different times. The direction of horizontal spin is determined by whether light strikes row A1 before it strikes row B1. An additional measurement is made to determine the difference in time between the light striking Row A and the light striking Row B, or vice versa.

Interpretation of the measurements is as follows: If the ball passes by the sensors 170, 172 with no spin, light is first reflected onto the first row of sensors A, A1 and then onto the second row of sensors B, B1. There will be essentially no time difference between the signals from the rows of the two sensors, thereby indicating that there is no horizontal spin component on the ball.

Horizontal spin is indicated when there is a difference in the signals measured between the two sets of rows A/A1 and B/B1 for the two sensors. The rate of spin is proportional to the difference in time for light reflected from the spinning ball to travel the distances d and d1, if the ball is centered between sensors. If the ball is not centered, the amount that the ball is off-center can be calculated by knowing where the ball strikes the net. Thus the horizontal spin rate can be corrected prior to calculating the trajectory of the ball.

The vertical spin component is represented by the arrow 222. Vertical spin is measured by comparing values from two velocity measurements. The first velocity measurement is discussed hereinabove: that is, the time between the ball's passing by the sensors 170, 172 and striking the net 140. This measures total velocity (TV). The second velocity measurement measures the time between light reflected off of the ball being received by the first sensor row A and the second sensor row A1. To compensate for the ball being closer to one sensor, an average is taken of the velocity voltage measurements for each sensor to obtain an average difference. The vertical spin component is obtained by algebraically subtracting the first velocity measurement from the second velocity measurement. If the result is zero, there is no vertical spin. If the result is not zero, the magnitude and direction of the vertical spin is obtained.

The sensors 170, 172 produce signals which are indicative of the time required for a reflected light beam to pass from rows A to B and from rows A1 to B1. These signals are supplied to the computer in an appropriate digital format.

Figure 5:
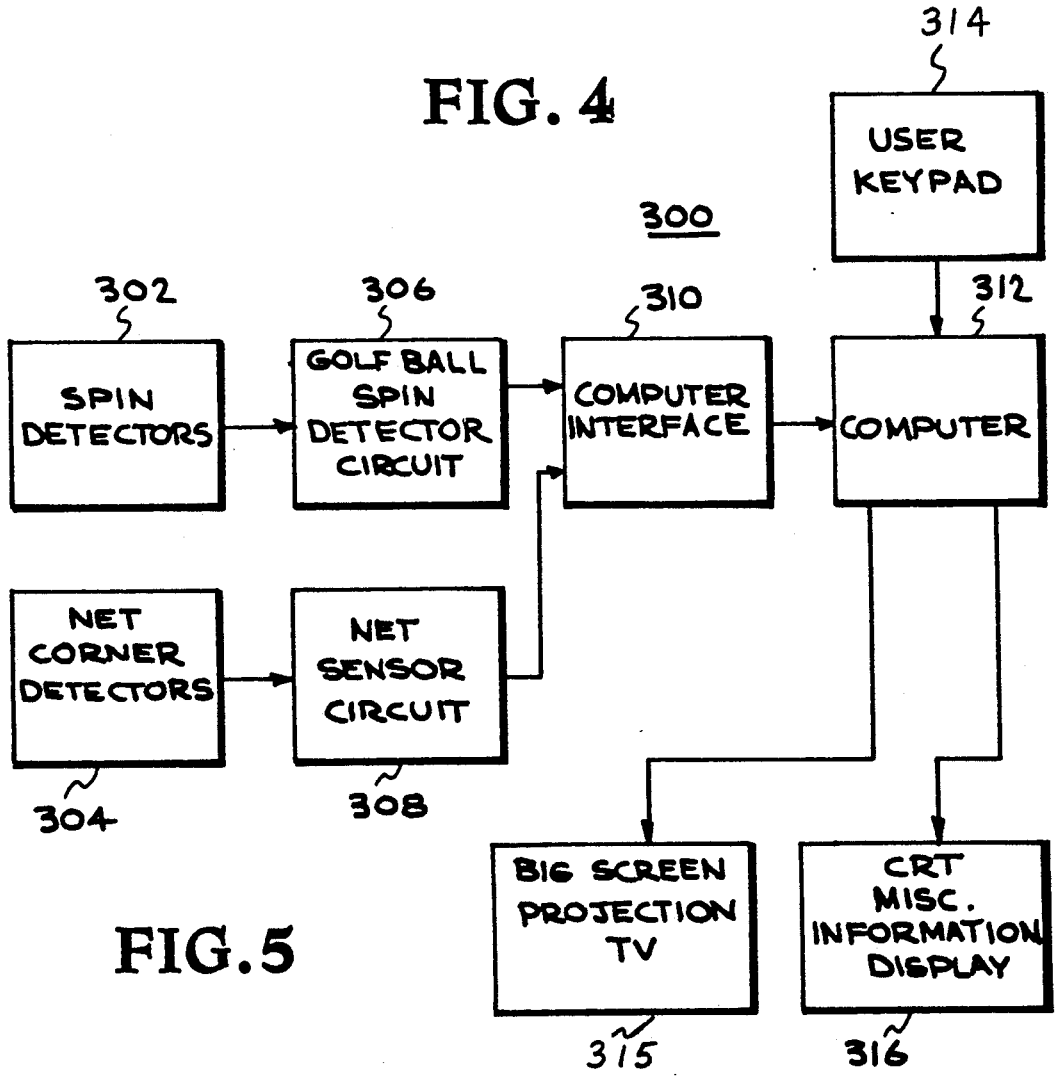
FIG. 5 is a functional block diagram of a golf simulation system.

FIG. 5 shows a functional block diagram 300 of a golf simulation system. Analog signals are produced by the spin detectors and the net sensors, as indicated by blocks 302, 304. As indicated by block 306, information from the golf spin detector sensors provides raw digital spin readings. This block also indicates when the ball intersects the light paths from the light sources. In block 308 analog signal information from each of the four net sensors is converted to provide raw digital sensor readings. The block 308 also indicates the time when and where the ball reaches the net. The signals from block 306, 308 are fed through a computer interface (as indicated by block 310) to a computer at block 312. A keypad (represented by block 314) is provided to a golfer in order to access the computer to initiate a game of golf and to interact with the computer as the golf game progresses. The keypad permits the golfer to control those aspects of the screen and those game functions which require user input. The computer processes and causes various items to be displayed: the golf course as viewed from the golfer's vantage point; the ball's projected motion as determined by the computer; the distance of the ball from the simulated hole; and the amount of enhancement provided to a player (as described hereinbelow.

This information is displayed using a video projection system or an additional display device. Block 315 indicates a big screen projection TV system, such as the projector 122 for the screen 120 of FIG. 1. Block 316 indicates a CRT or computer screen display. The computer also automatically causes a printout to be made of a map of the green area, with the location of the ball so that a player can accurately place the ball in the green portion of the simulated course and play out the hole.

Once the data on ball spin, trajectory, and velocity is processed and computed by the computer, the trajectory and motion of the ball is displayed. The view displayed on the projection screen 120 by the video projector 122 is updated to reflect the new view from the new ball position to the green. The actual location of the ball is overlaid on a map of the hole and displayed on the monitor 132. Alternatively, the flight path of the ball is displayed by the video projector on the projection screen 120. The position of the ball on the screen is displayed in conjunction with such notices as "out of bounds," "hazards," "fairway." "rough," etc., as appropriate. Note that information relating to a player's skill level, such as stroke handicap and enhancement factor (described below), can also be displayed.

If a ball enters the imaginary rough, the computer randomly assigns a certain playing condition to the ball based, for example, on a predetermined percentage. For example, the computer may assign certain percentages to various conditions such as lost-ball, unplayable lie, out-of-bounds, or a playable chip-out.

This type of simulated golf enables one or more players to simultaneously use the computer and display media to play the longest part of a hole, while the green area of the simulator is used to play near shots and to putt. The exact location of the ball from the hole or green surround is displayed. A printer can be integrated with the computer to provide a printout of the hole and its surround, with the position of each player's ball indicated thereon. The printout can also be used to document each player's score, handicap, or enhancement factor or percentage.

Figure 6:
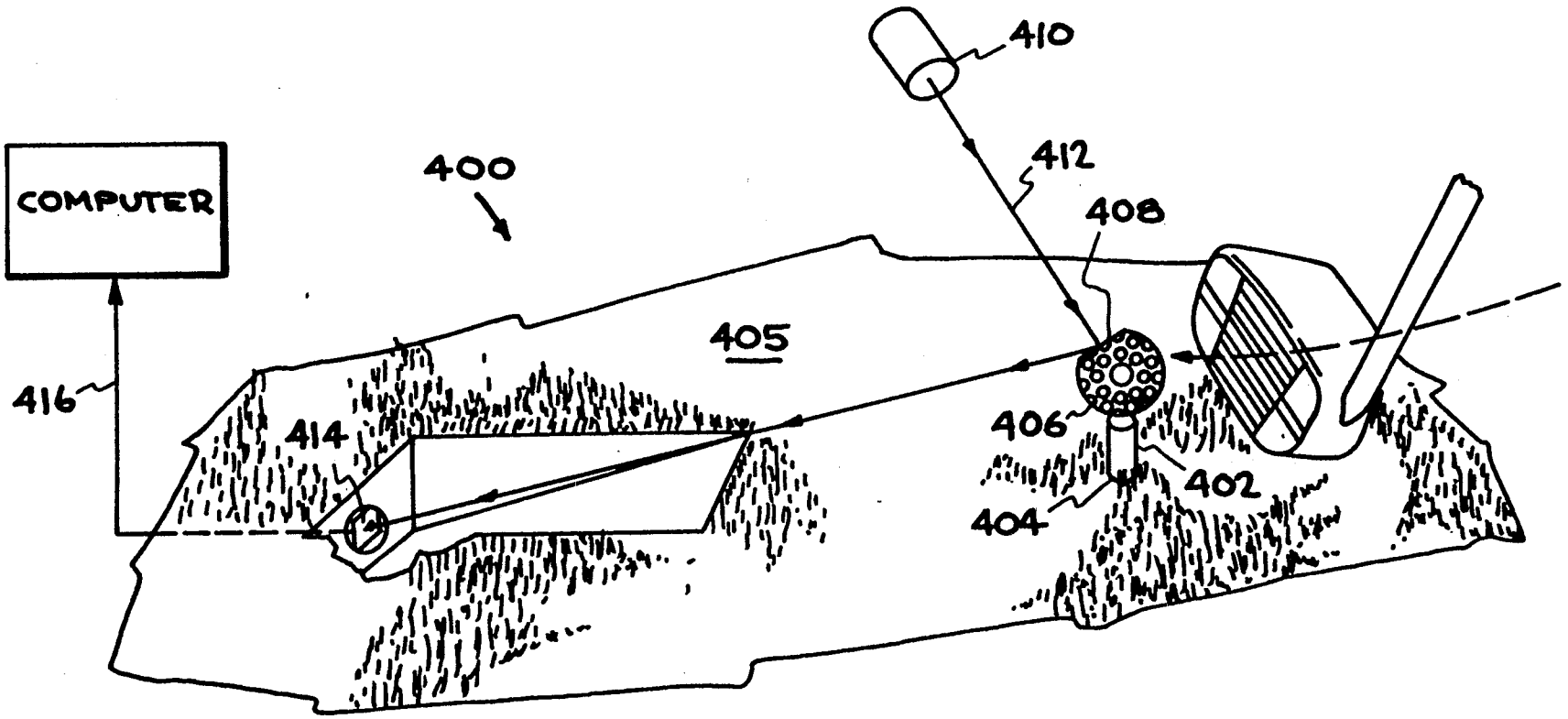
FIG. 6 is is a perspective partially diagrammatic view of an alternative spin sensing system.

FIG. 6 shows an alternative tee and spin sensing system 400. A resilient tee element 402 protrudes upwardly through a hole 404 in a mat 405 of carpet, grass, or artificial turf. The tee element 402 is anchored by a flange portion which extends beneath the mat. The upper end of the tee element is shaped to support a golf ball-like element 406 having a reflective surface portion 408, which is used as described below.

A light source 410 directs a beam 412 of energy at the ball-like element 406 on the tee. A ball movement sensor 414 serves to provide information for computer analysis of the movements of the golf ball-like element 406. The sensor 414 is disposed in the direction of movement of the ball element 406 and is oriented transversely to that direction. Prior to a player striking the ball element, the ball element 406 is oriented on the tee so that the reflective surface 408 directs light from the beam 412 onto the sensor means 414, as indicated in the Figure. Signals from the sensor are provided on a signal line 416 to the computer.

Figure 7:
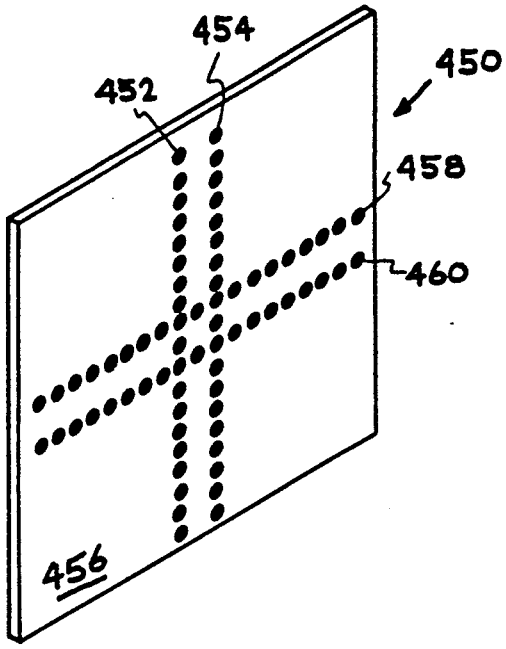
FIG. 7 is an enlarged diagrammatic view of a spin sensing plate.

FIG. 7 shows an embodiment of the sensor means, that is, a spin-sensing plate 450. The sensor means includes an array of photo-detectors, which comprises a pair of laterally-spaced, vertically-disposed lines 452, 454 of individual sensor elements carried on a semi-rigid support board 456. The board 456 also carries a pair of vertically-spaced, horizontally-disposed lines 458, 460 of sensor elements. The sensor detects horizontal and vertical spin of the ball-like element 406 as explained below. The sensor board 456 provides information representative of the spin of the ball-like element 406 in two axes.

If the ball-like element 406 is struck and rotated clockwise as shown in FIG. 6, the light reflected onto the sensor board 456 will move upwardly along the lines 452, 454. Thus, the time between illumination, or flashing of the light on and off, of the individual sensor elements in the vertical lines 452, 454, provides an indication of the amount of upward spin, or vertical spin, on the ball about a horizontal axis. Similarly, the time between illumination of the sensor elements in the horizontal lines 458, 460 of sensor elements provides an indication of the amount of horizontal spin around a vertical axis to determine the amount of slice or hook for a particular shot. The direction of the vertical spin depends on whether the sensors are illuminated from left to right or vice versa. Generally, spin can be detected by monitoring the individual detectors as they switch on and off in the array.

Figure 8:
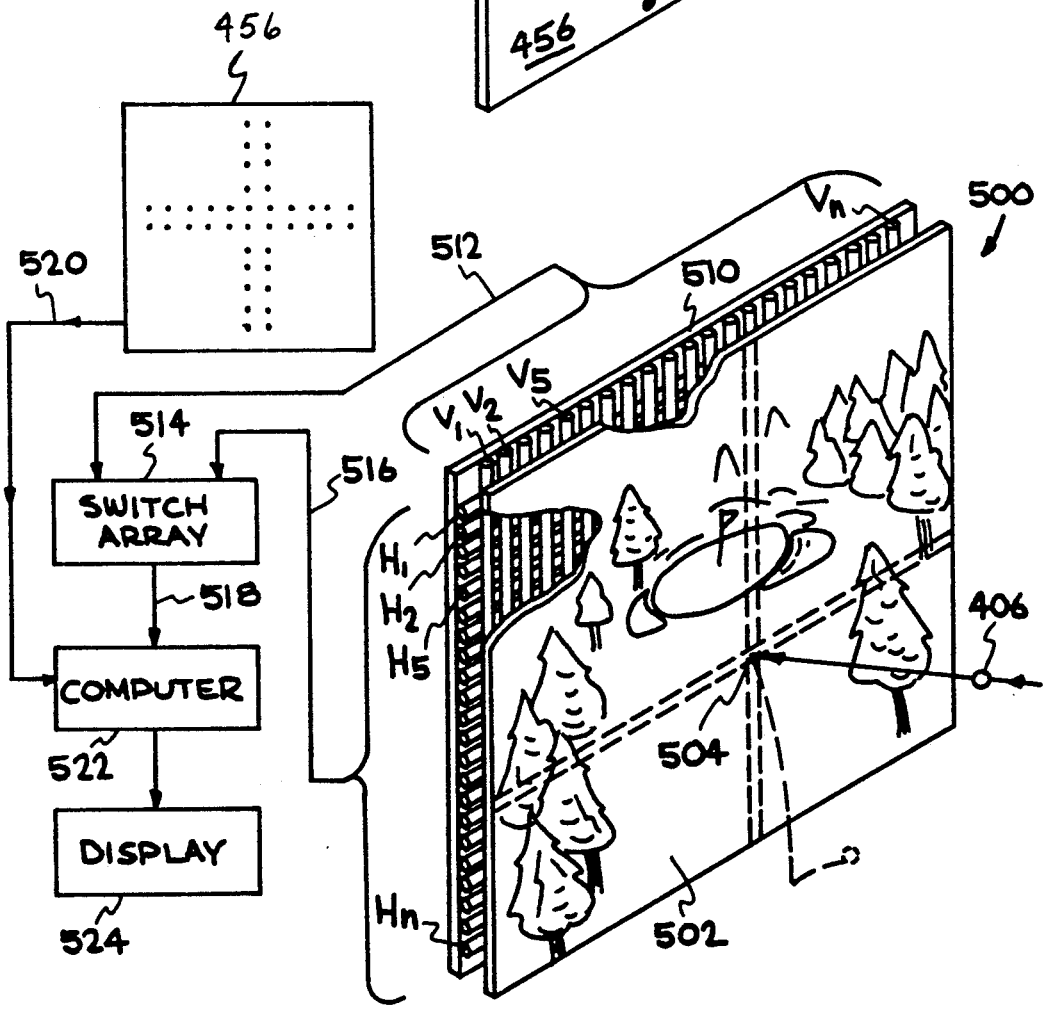
FIG. 8 is a perspective, partially diagrammatic view of a target screen interconnected with a spin sensor to provide information to a computer and display system for a golf simulator.

FIG. 8 shows another embodiment of a target screen assembly 500, which is interconnected with the spin sensor 450 to provide information to a computer and display system for a golf simulator. An image of the hole being played is projected onto a flexible screen 502 to form a representational target. The target assembly 500 functions to detect the point 504 where a ball or ball-element 406 strikes the assembly. The target assembly includes a matrix of conductors comprising a first plurality of vertically-disposed conductors Vl–Vn and a second plurality of horizontally-disposed conductors Hl–Hn. The vertically-disposed conductors are arranged to be in a first vertical plane, while the horizontally-disposed conductors are arranged to be in a second vertical plane. These two planes are closely spaced apart and are free from electrical contact therebetween except when they are struck by a driven ball.

The flexible sheet of screen material 502 is hung in front of the matrix for displaying an image of the golf hole being played. A semi-rigid sheet of material 510 is disposed behind the matrix. A driven ball strikes the flexible sheet 502 and moves a vertically-disposed conductor into contact with a horizontally-disposed conductor to thereby identify the point of impact of the ball on the screen. This arrangement permits the horizontal and vertical positions of the point of impact of the ball to be identified as the intersection of one of the vertical conductors with one of the horizontal conductors.

FIG. 8 shows that an output signal from the vertically-oriented array of conductors is supplied via a cable 512 to a switch array 514. Similarly, an output signal from the horizontally-oriented array of conductors is supplied via a cable 516 to the switch array 514. The switch array is thus provided with input information to identify the point on the screen where the ball has struck the screen.

The velocity, or speed, of the ball is used to calculate the distance that a ball is hit along the simulated fairway. In the embodiments of FIGS. 6–7, and FIG. 8, velocity is detected by first observing that the ball has been struck. This is indicated by observing that the reflective portion 408 of the ball-like element 406 has moved, as detected by the elements on the sensor board 456. This information is supplied from the sensor board via a cable 520 to the computer 522. The occurrence of an output signal from the switch array 514 is provided on a signal line 518 to the computer, which indicates that the target has been struck by the ball-like element. Having both the time of the beginning of flight of the ball and the time that the ball hits the target, as well as the distance between the tee and the target, the computer then calculates the difference between these two times to obtain the time of flight of the ball from the tee to the target. The computer subsequently generates an output display on the a display monitor 524 or on the projection screen which indicates the distance that the ball has been hit on the simulated fairway. This distance is calculated using the forward velocity of the ball and the spin on the ball as two of the variables in an equation simulating the flight of a golf ball. Since the simulated distance that a ball is hit is proportional to the forward velocity of a ball, the simulated distance can be changed by modifying the value of the forward velocity of the ball. By increasing the value of velocity processed by the computer, the simulated performance of a player can be enhanced.

Figure 9:
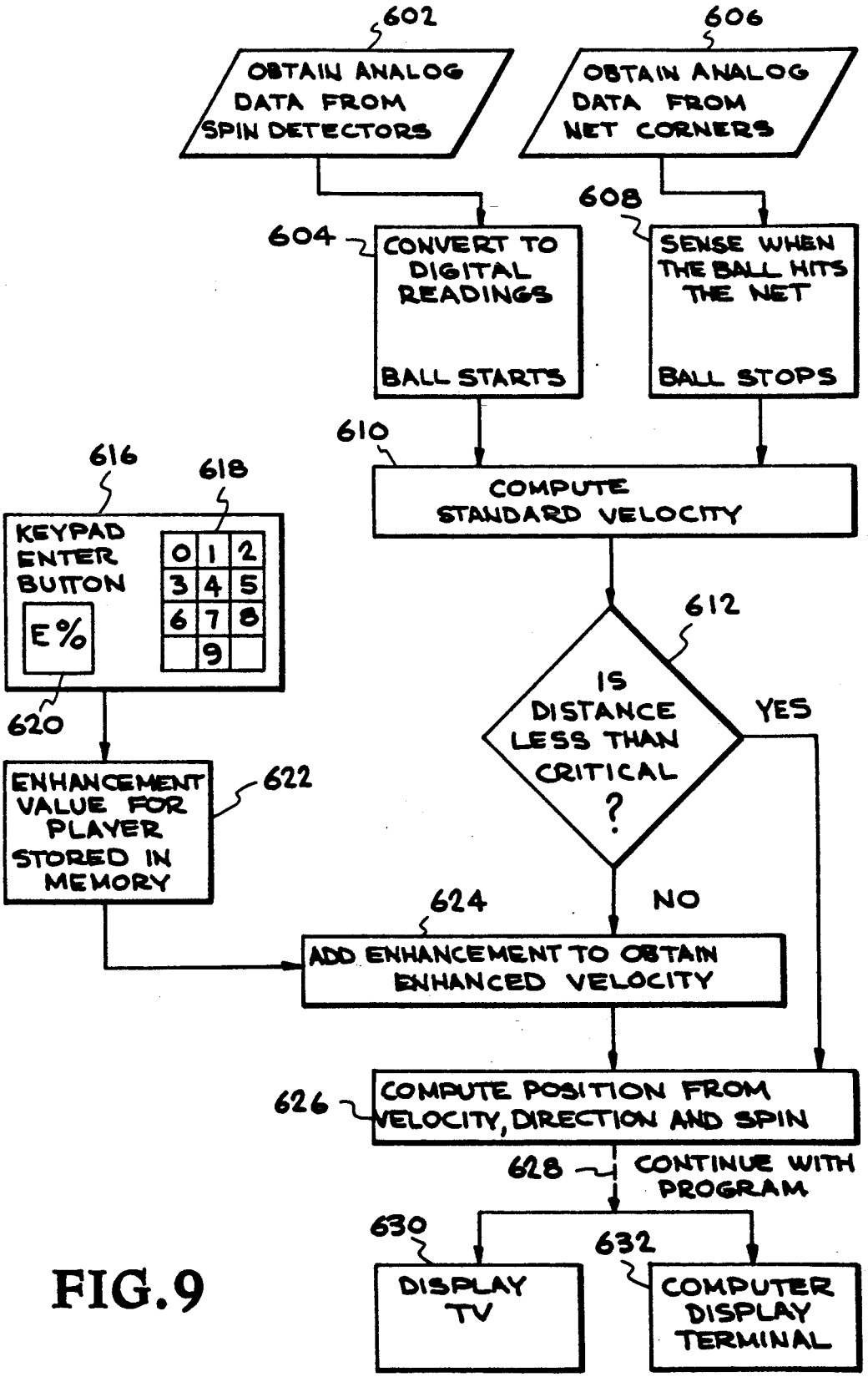
FIG. 9 is a flow diagram showing the steps for adding performance enhancement to a golf simulation system according to the invention.

FIG. 9 is a flow diagram which shows steps for adding performance enhancement to a golf simulation system according to the invention. A better player generally takes fewer strokes, or shots, and hits the golf ball farther and more accurately than does a poorer player. Less-skilled players slow the pace of the game, even when using a simulator of the type described hereinabove. The handicap system does not solve the problems caused by the less skilled, and usually slower, players in a group.

The invention provides a technique to actually enhance the simulated performance of the poorer players to a level more competitive with a better player. This is accomplished by providing a means for enhancing a player's performance with a performance enhancement factor. The final position of a driven ball is determined by several player-controlled factors, including spin, trajectory, and measured velocity. The final distance that a player's ball travels is proportional, along with several other variables, to the velocity of the ball as it leaves the tee. Enhancing the value of the apparent measured velocity of a player's shot increases the simulated distance that a ball will travel and, thus, enhances a player's apparent ability.

The invention provides each player with, for example, a percentage factor by which the measured velocity of a player's ball in increased. This enhanced velocity is then used along with the other variables (such as direction and spin) as the basis for computing the lie, or location on the simulated course, of the player's ball in the simulated system. The inter-relationship of the various variables, such a velocity, direction, and spin, are combined into formulas provided by golf ball manufacturers to calculate the distance that a ball will travel. Other variable such as wind can also be included in such a calculation.

An enhancement percentage is assigned to a player at the beginning of a round. The enhancement percentages could vary over a range such as, for example, zero to two-hundred percent, as assigned to each player at the beginning of a round. Entry of such enhancement percentages is made through a user data entry keyboard or terminal. A one-hundred percent enhancement factor improves a player's ball velocity by a factor of two. A 200 percent enhancement factor improves a player's ball velocity by a factor of three. In a simple velocity-enhancement system, direction and spin are variables still controlled by the player.

Figure 10:
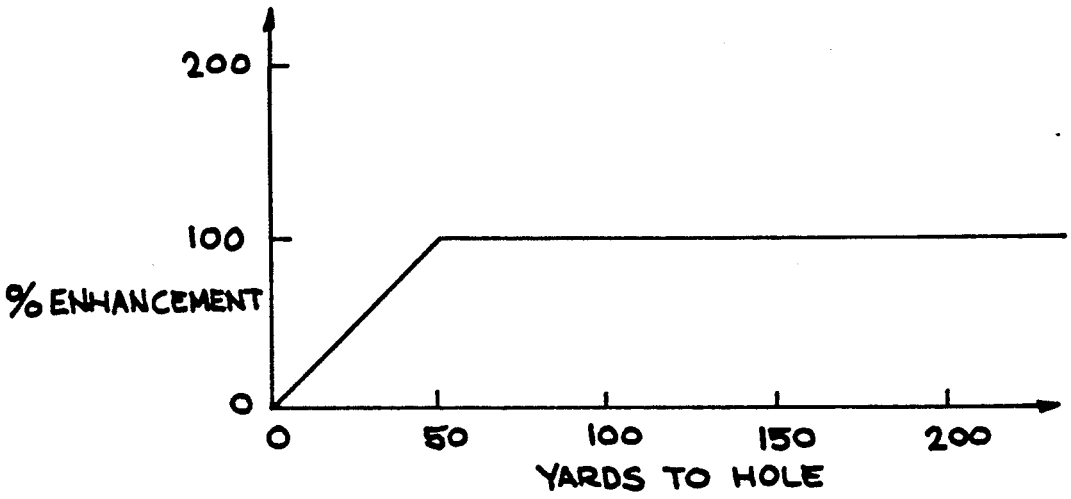
FIG. 10 is a plot of a preferred performance enhancement characteristic, which is linear near the hole and constant beyond 50 yards.

FIG. 10 is a plot of a preferred performance enhancement characteristic. As a player approaches the green, the need for an enhancement factor diminishes. For shots within a predetermined distance from the green, the enhancement factor can be removed or linearly decreased as a function of distance from the hole. The computer system can be programmed to automatically attenuate the enhancement factor as a function of distance from the hole. FIG. 10 shows, for example, a preferred enhancement characteristic which is linear near the hole and which is constant beyond 50 yards. Of course it is contemplated that characteristic and the attenuation can be programmed with a number of profiles, including a linear, non-linear, or a step function of the distance from the hole, as desired.

With reference to FIG. 9 of the drawings, the functional flow chart is provided to provide an overview and to describe the operations of the computer system in implementing enhancement of a player's skill in a simulated golf system. This block is similar to the diagram of FIG. 5 for a golf simulation system without velocity enhancement. Input block 602 provides for obtaining analog readings from the spin detector circuits. In block 604 the analog signals are converted to digital spin readings and to a signal indicating that the ball has been struck on the tee. Input block 606 provides for obtaining the analog readings from the corners of the net, as in FIG. 1 or from the vertically-oriented array of conductors of FIG. 8. Block 608 indicates that the sensors signals are processed to provide an output signal indicating when the ball hits the screen or net. As indicated by block 610, the signals indicating starting and stopping of the flight of the ball are then processed, as described hereinabove, in the computer to compute the standard velocity of the ball from the sensor inputs.

A decision block 612 indicates whether velocity-enhancement is to be used based on a decision in which the distance from the tee or place on the fairway or rough to the hole is compared to a predetermined critical distance stored in the computer memory. If the distance for the next shot is less than the critical distance, or if no critical distance is specified, block 624 indicates that the enhancement percentage is to be used to obtain an enhanced velocity value. The enhancement value, for example, an enhancement percentage, is provided by a player from a user keypad 616, which includes a set 618 of numeric keys for entering numeric values and an enter button 620 for forwarding information about the player's enhancement percentage to the computer memory, as indicated by the block 622. The enhancement percentage can, optionally be modified by an attenuation factor, which may vary as a function of distance to the hole, to provide a modified enhancement percentage, or factor, as indicated by the plot FIG. 10. This function can be a linear, non-linear, or a step function of the distance from the hole. As indicated by block 624, the modified enhancement percentage is applied to the value of the standard velocity to provide a value for the enhanced velocity variable. Block 626 indicates that the enhanced velocity variable is used, along with other variable such as direction and spin, to compute the final position of the ball on the simulated golf course.

If enhancement is not being used for that particular player, block 626 indicates that the computer uses the standard velocity value and the values of the other variables, such as direction and spin, to compute the position of the ball using manufacturer's ball-flight formulas. Not all players are required to use enhancement and enhancement is selectively applied to designated players. One player in a group may use enhancement according to the invention, while another player in the same group does not use enhancement.

The dotted line 638 indicates that the computer proceeds to perform additional computations. Finally, block 630 indicates that the computer provides information and control signals for the big-screen projection TV display. Block 632 indicates that information signals are also available for being displayed on the display terminal for the computer.

Figure 11:
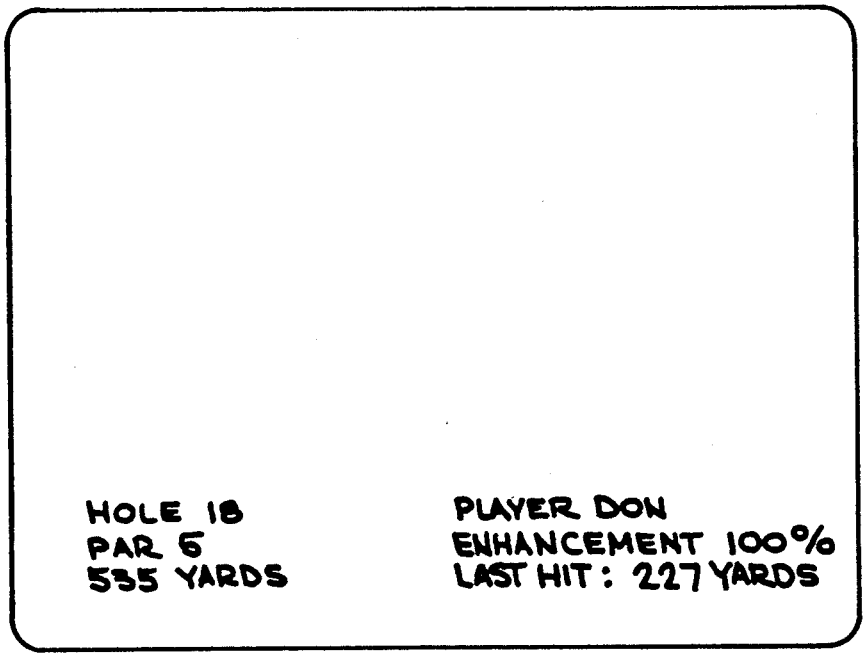
FIG. 11 shows a display-screen format for displaying information about the amount of enhancement provided to a user of a golf simulation system having the performance enhancement provided according to the invention.

FIG. 11 shows an exemplary display screen format for displaying information about the amount of enhancement provided to a user of a golf simulation system having the performance enhancement provided according to the invention. Various information items are optionally displayable on such a screen. This screen format can be presented on the computer monitor or the projection screen. This screen format can also be superimposed over the scene for the hole being played on the large display area of the projection screen for the simulation system. For example, these information items can include: the player's name; the player's enhancement factor or percentage; the hole number; par; or the distance for the red, white, and blue tees. Information about a player's use and amount of enhancement is clearly displayed to avoid cheating, that is, having a player benefit from enhancement without notifying other players. The computer can also keep track of the use of enhancement and provide information on the amount of enhancement for each player in reports and printouts, as appropriate, for a golf league or a golf tournament played on a simulated course.

Note that the use of the enhancement factor or percentage, according to the invention, can be used with other golf simulation systems which measure various performance parameters indicative of the performance of a player striking the golf ball. For example, one type of golf simulator measures the speed and the angle of a clubhead and uses that information to compute the final position of a hit ball on a simulated course. No measurements are made of spin or of the actual velocity of the ball. In this type of simulator the enhancement can be added, for example, to the clubhead speed to enhance a player's skill level.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use comtemplated. It is intended that the scope of the invention be defined by the claims appended hereto and their equivalents.

I claim:

1. A golf simulation system, comprising:

display means for displaying a simulated golf hole;

sensor means for measuring one or more parameters indicative of the performance of a player in striking a golf ball;

computer means for determining the simulated distance and location of the hit golf ball from the simulated hole as a function of the measured one or more parameters indicative of the performance of the player; said display means being connected to said computer means;

said computer means including shot enhancement means for relatively enhancing a player's shot by a predetermined enhancement factor; and means for loading and storing a predetermined enhancement factor into a memory system for said computer means.

2. The golf simulation system of claim 1 including means for inputting an enhancement factor to be applied to the player.

3. The golf simulation system of claim 2 wherein the means for inputting an enhancement factor to be applied to the player include keyboard means for entering information relative to the player into the computer means.

4. The golf simulation system of claim 1 wherein the sensor means for measuring one or more parameters indicative of the performance of a player in striking a golf ball includes means for measuring the velocity of the golf ball.

5. The golf simulation system of claim 4 wherein the shot enhancement means includes means for increasing the calculated forward velocity of a hit ball to obtain an enhanced simulated forward velocity for that hit ball.

6. The golf simulation system of claim 5 wherein the means for increasing the calculated forward velocity of a hit ball to obtain an enhanced forward velocity for that hit ball includes means for enhancing the forward velocity by a predetermined percentage.

7. The golf simulation system of claim 1 wherein the computer means includes means for automatically phasing out the enhancement factor as the player approaches the simulated hole.

8. The golf simulation system of claim 7 wherein the means for automatically phasing out the enhancement as the green is approached includes means attenuating the enhancement factor according to a predetermined scheme as a function of the player's distance from the hole.

9. The golf simulation system of claim 1 wherein the display means includes means for displaying the enhancement factor of a player.

10. A golf simulation system, comprising:

display means for displaying a simulated golf hole;

sensor means for measuring the velocity, trajectory, and spin of a golf ball hit with a golf club by a player;

computer means for determining the distance and location of the hit golf ball from the simulated hole as a function of the measured velocity, trajectory, and spin of the golf ball, said display means being connected to said computer means;

said computer means including shot enhancement means for relatively enhancing a player's shot by a predetermined enhancement factor; and means for loading and storing a predetermined enhancement factor into a memory system for said computer means.

11. The golf simulation system of claim 10 wherein the shot enhancement means includes means for increasing the calculated forward velocity of a hit ball to obtain an enhanced forward velocity for that hit ball.

12. The golf simulation system of claim 11 wherein the means for increasing the calculated forward velocity of a hit ball to obtain an enhanced forward velocity for that hit ball includes means for enhancing the forward velocity by a predetermined percentage.

13. The golf simulation system of claim 12 wherein the predetermined percentage ranges between 0 and 200 percent.

14. The golf simulation system of claim 10 wherein the computer means includes means for automatically phasing out the enhancement factor as the player approaches the simulated hole.

15. The golf simulation system of claim 14 wherein the means for attenuating the enhancement as the green is approached includes means attenuating the enhancement factor according to a predetermined scheme as a function of the player's distance from the hole.

16. The golf simulation system of claim 14 wherein the means for automatically phasing out the enhancement facto as the green is approached includes means for cancelling the enhancement factor at a predetermined distance from the hole.

17. The golf simulation system of claim 10 wherein the display means includes means for displaying the enhancement factor of a player.

18. An improved method of simulating a golf game, comprising the steps of:

displaying a simulated golf hole;

measuring with sensors one or more parameters indicative of the performance of a player striking a golf ball with a golf club;

computing the distance and location of the hit golf ball from the simulated hole as a function of the one or more measured parameters of the struck golf ball;

enhancing a player's shot with a predetermined enhancement factor; and loading and storing the predetermined enhancement factor into a memory system.

19. The method of claim 18 including the step of loading the predetermined enhancement factor from a keyboard.

20. The method of claim 18 wherein the step of enhancing a player's shot with a predetermined enhancement factor includes increasing the calculated forward velocity of a hit ball to obtain an enhanced forward velocity for that hit ball.

21. The method of claim 20 wherein the step of increasing the calculated forward velocity of a hit ball to obtain an enhanced forward velocity for that hit ball includes enhancing the forward velocity by a predetermined percentage.

22. The method of claim 18 including the step of attenuating the enhancement factor as the player approaches the simulated hole.

23. The method of claim 22 wherein the step of automatically phasing out the enhancement factor as the hole is approached, includes attenuating the enhancement factor according to a predetermined scheme as a function of the player's distance from the hole.

24. The method of claim 22 wherein the step of automatically phasing out the enhancement factor as the hole is approached includes cancelling the enhancement factor at a predetermined distance from the hole.

25. The method of claim 18 wherein the step of displaying a simulated golf hole includes displaying the enhancement factor of a player.

26. An improved method of simulating a golf game, comprising the step of:

displaying a simulated golf hole;

measuring with sensors the velocity, trajectory, and spin of a golf ball hit with a golf club by a player;

computing the distance and location of the hit golf ball from the simulated hole as a function of the measured velocity, trajectory, and spin of the hit golf ball;

enhancing a player's shot with a predetermined enhancement factor which increases the calculated forward velocity of a hit ball to obtain an enhanced forward velocity for that hit ball;

automatically phasing out the enhancement factor as the player approaches the simulated hole according to a predetermined scheme as a function of the player's distance from the hole; and displaying the enhancement factor of a player.

* * * * *